US006231388B1

(12) United States Patent
Murakami et al.

(10) Patent No.: US 6,231,388 B1
(45) Date of Patent: May 15, 2001

(54) WATERPROOF CONNECTOR

(75) Inventors: Takao Murakami; Masaru Fukuda, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/536,395

(22) Filed: Mar. 28, 2000

(30) Foreign Application Priority Data

Mar. 29, 1999 (JP) ..... 11-087014

(51) Int. Cl.[7] ..... H01R 13/40
(52) U.S. Cl. ..... 439/587; 439/273
(58) Field of Search ..... 439/271–275, 439/587

(56) References Cited

U.S. PATENT DOCUMENTS 5,336,101 * 8/1994 Kasugai et al. ..... 439/272
5,580,264 * 12/1996 Aoyama et al. ..... 439/275

FOREIGN PATENT DOCUMENTS

0553872A1 1/1993 (EP) .
0964481A200 12/1999 (EP) .
62-188069 8/1987 (JP) .
11-354200 12/1999 (JP) .
WO 96/14675 5/1996 (WO) .

* cited by examiner

*Primary Examiner*—Renee Luebke
*Assistant Examiner*—Briggitte R. Hammond
(74) *Attorney, Agent, or Firm*—Finnegan, Henderson, Farabow, Garrett & Dunner, L.L.P.

(57) ABSTRACT

A waterproof connector capable of improving its assembling workability is provided. The connector includes an outer housing 17, a spacer 28 and rubber plugs 18. Each rubber plug 18 is provided, on its axial ends, with cylindrical parts 18*c*, 18*c*'. The outer housing 17 has rubber accommodating recesses 19 formed in its bottom wall 17*c* for accommodating the parts 18*c*, 18*c*' of the plug 18*s*. The spacer 28 has recesses 28*e* formed outside its spacer wall 28*c* for receiving the cylindrical parts 18*c*, 18' of the rubber plugs 18. Each rubber accommodating recess 19 of the outer housing 17 is provided, on its inlet part for the rubber plug 18, with a tapered face 19*a*, while each recess 28*e* of the spacer 28 is provided, on its inlet part for the rubber plug 18, with a tapered face 28*d*. At the temporary engagement of the plugs 18 between the outer housing 17 and the spacer 28, the parts 18*c*, 18*c*' of the plugs 18 are accommodated into at least either one of the recesses 19, 28*e*.

6 Claims, 5 Drawing Sheets

WATERPROOF CONNECTOR

BACKGROUND OF THE INVENTION

1. Field of the Invention

The present invention relates to a compact and multi-pole waterproof connector which improves the waterproof capability between a connector housing and a plurality of wires connected with terminals.

2. Description of the Related Art

The applicant of the present invention has previously proposed this kind of waterproof connector in Japanese Patent Application No. 10-162521 (not a prior art). FIGS. 1 to 3 show the structure of the waterproof connector. As shown in FIGS. 1 and 2, a connector housing 11 of the waterproof connector 10' has a synthetic resinous inner housing 12 having a plurality of terminal accommodating chambers 13 formed integrally, a synthetic resinous outer housing 17 for fitting the inner housing 12 therein, and a synthetic resinous spacer 28 interposed between the inner housing 12 and the outer housing 17 to retain female terminals 14 accommodated in the terminal accommodating chambers 13 of the inner housing 12.

The inner housing 12 is provided with a box part 12*a* having upper and lower openings formed on rear sides of the housing 12. In the housing 12, terminal accommodating chambers 13 are defined by a center horizontal wall 12*b* and upper and lower vertical sidewalls 12*c* in order to accommodate female terminals 14 in the chambers 13, respectively. On the upper and lower faces of the box part 12*a* and at the center of the part 12*a*, respective engagement claws 15 are formed integrally with the housing 12. Further, the housing 12 has flanges 16 integrally formed at respective front ends of the upper and lower faces of the box part 12*a*. Note, on the front wall of the box part 12*a* at respective positions corresponding to the terminal accommodating chambers 13, rectangular through-holes 12*d* are formed for allowing male terminals (not shown) of the mating connector through. In each female terminal 14, a box part 14*a* is provided, on each side plate thereof, with a pair of press-fitting edges 14*b*, 14*b* both folded at the rear part of the terminal 14.

The outer housing 17 comprises an inner wall 17*a* in the form of a substantially rectangular cylinder, an outer wall 17*b* in the form of a substantially rectangular cylinder as well, and a bottom wall 17*c* connected the inner and outer walls 17*a*, 17*b* with each other, providing a double-box having an opening at its front end.

Inside the bottom wall 17*c*, rubber plug accommodating recesses 19 are formed at respective positions corresponding to the terminal accommodating chambers 13, for accommodating waterproof rubber plugs 18'. The bottom wall 17*c* has wire through-holes 21 formed to allow wires 20 through. Each waterproof rubber plug 18' is in the form of a substantial cylinder having uneven inner and outer peripheral faces, also allowing the wire 20 through.

The spacer 28 comprises a rectangular-cylindrical body part 28*a* in the form of a generally rectangular cylinder fitted to the outer housing 17, a flange part 28*b* in the form of a generally rectangular cylinder fitted to the outer housing 17, and a bottom wall 26*c* of the body part 28*c*, providing a box having a front section opened.

In the assembled state, the box part 12*a* of the inner housing 12 is fitted at the interior of the body part 28*a* of the spacer 28.

Corresponding to the wire through-holes 21 of the outer housing 17, the spacer 28 has also wire through-holes 33 formed in the bottom wall 28*c* so as to respectively oppose the holes 21 of the outer housing 17 in engagement with the spacer 28. The bottom wall 28*c* of the spacer 28 is configured so as to retain the rubber plugs 18' at the completion to fit the spacer 28 to the outer housing 17. Before being retained, the rubber plugs 18' have been inserted into the rubber plug accommodating recesses 19 in the bottom wall 17*c* of the outer housing 17. As shown in FIG. 2, the wires 20 penetrating through the through-holes 21 of the housing 17, respective through-holes 18*b* of the rubber plugs 18' and the through-holes 33 of the spacer 28, are disposed between the press-fitting edges 14*b*, 14*b* in respective pairs, into pressure-connection with the female terminals 14 accommodated in the terminal accommodating chambers 13 of the inner housing 12. With the above arrangement, the terminal accommodating chambers 13 and the wires 20 are waterproofed owing to the rubber plugs 18 and a rubber packing 24 interposed between the outer housing 17 and the spacer 28.

In the bottom wall 17*c* of the outer housing 17, each rubber plug accommodating recess 19 is provided, on its inlet side, with a reversed conical face (tapered face) 19*a*. Similarly, the bottom wall 28*c* of the spacer 28 is provided, about each through-hole 33, with a reversed conical face (tapered face) 28*d*.

As shown in FIGS. 3A, each rubber plug 18' allowing the wire 20 through is provided, on both axial ends thereof, with conical faces (tapered faces) 18*a*, 18*a*. In the dimensional establishment, an inner diameter Rb of the rubber plug 18, i.e., a diameter of the through-hole 18*b* is equal to or more than a diameter R of the wire 20 ($Rb \geqq R$). In addition, an outer diameter Ra of the rubber plug 18' is more than a diameter D of the rubber plug accommodating part 19 and there is established a sealing relationship of ($Ra-Rb+R>D$) in the rubber plug accommodating recess 19.

FIG. 1 shows a temporary engagement condition where the rubber plug 18' is not fitted into the recess 19 completely. The reason of incomplete fitting is to reduce an insertion force in inserting the wires 20 into the rubber plugs 18' at the next-coming formal engagement.

Nevertheless, since the rubber plugs 18' under the above temporary engagement condition is simply pinched between the reversed conical faces 19*a* of the outer housing 17 and the reversed faces 28*d* of the spacer 28, there may be occurred a problem of the rubber plugs 18' being detached from the formal position between the reversed conical faces 19*a* of the outer housing 17 and the same 28*d* of the spacer 28 due to vibrations, external force, etc.

Additionally, as shown in FIG. 3B, one conical face 18*a* of the rubber plug 18' comes into "surface" contact with the reversed face 19*a* of the rubber plug recess 19 of the outer housing 17 while increasing the frictional force therebetween. Therefore, it requires a large insertion force against the plugs 18 to force the rubber plugs 18' into the recesses 19 of the outer housing 17 through the reversed conical faces 28*d* of the spacer 28. Consequently, there is a possibility of the assembling workability of the waterproof connector 10' being deteriorated.

SUMMARY OF THE INVENTION

Under the circumstances, it is therefore an object of the present invention to provide a multi-pole waterproof connector which is capable of the improvement of assembling workability. It is also an object to provide a method of producing the above waterproof connector.

The former object of the present invention described above can be accomplished by a waterproof connector composed of a connector housing which has a plurality of terminal accommodating chambers adapted so as to accommodate a plurality of terminals to be connected to electrical wires, and rubber plugs for insulating the terminals accommodating chambers and the wires from the outside of the connector housing in a waterproof manner, the connector housing comprising:

an inner housing having the terminal accommodating chambers formed therein;

an outer housing into which the inner housing is to be fitted; and a spacer disposed between the inner housing and the outer housing to retain the terminals accommodated in the terminal accommodating chambers; and wherein the outer housing has wire through-holes formed on its housing wall facing the terminal accommodating chambers of the inner housing being assembled into the outer housing, and rubber accommodating recesses formed on an inner side of the housing wall at respective positions opposing the wire through-holes, to receive the rubber plugs each provided, on both axial sides thereof, with cylindrical parts;

the spacer has wire through-holes formed on its spacer wall facing the wire through-holes of the outer housing being engaged with the spacer, and recesses formed on an outer side of the spacer wall at respective positions opposing the wire through-holes of the spacer, to receive the cylindrical parts of the rubber plugs;

each of the rubber accommodating recesses of the outer housing is provided, on its inlet part for the rubber plug, with a tapered face inclined to the axial direction of the rubber accommodating recess; and each of the recesses of the spacer is provided, on its inlet part for the rubber plug, with a tapered face inclined to the axial direction of the recess.

The above constitution allows the cylindrical parts of the rubber plugs to be securely accommodated into at least either ones of the rubber accommodating recesses of the outer housing and the recesses of the spacer at the temporary engagement to pinch the rubber plugs between the outer housing and the spacer prior to the insertion of the wires. Therefore, the rubber plugs can be prevented from being fallen from a space between the outer housing and the spacer. Consequently, the posture of the rubber plugs at the insertion of the wires can be stabilized to improve the assembling workability of the waterproof connector.

According to the second aspect of the invention, each of the rubber plugs is provided, about its periphery of a portion close to the cylindrical part on one axial side, with an annular projection which is contoured by a curved face, for point-contact with the tapered face of each of the rubber accommodating recesses of the outer housing.

In this case, since the projections of the rubber plugs come into "point" contact with the tapered faces of the rubber plug accommodating recesses of the outer housing at the temporary engagement, it is possible to stabilize and lower the frictional force between the rubber plug accommodating recesses of the outer housing and the rubber plugs at the complete fitting the spacer in the temporary engagement into the outer housing for the formal engagement. Therefore, it is possible to reduce the force required to insert the plugs into the rubber plug accommodating recesses, thereby improving the assembling workability of the waterproof connector.

According to the third aspect of the invention, each of the rubber plugs is provided, about its periphery of another portion close to the cylindrical part on the other axial side, with another annular projection which is also contoured by a curved face, for point-contact with the tapered face of each of the recesses of the spacer.

In this case, since the annular projections of the rubber plugs come into "point" contact with the tapered faces of the recesses of the spacer at the temporary engagement, it is possible to stabilize and lower the frictional force between the recesses of the spacer and the rubber plugs at the complete fitting the spacer in the temporary engagement into the outer housing for the formal engagement. Accordingly, it is possible to reduce the force required to insert the rubber plugs into the rubber plug accommodating recesses.

According to the fourth aspect of the invention, each of the rubber plugs is provided, between the annular projections on both axial sides, with at least one annular projection which is also contoured by a curved face.

In this case, owing to the addition of the annular projection between the projections on both axial sides of each rubber plug, the sealing capability of the rubber plug can be ensured while reducing the frictional force.

According to the fifth aspect of the invention, each of the rubber accommodating recesses of the outer housing is provided, on its inlet part for the rubber plug, with a conical face constituted by the tapered face and each of the recesses of the spacer is provided, on its inlet part for the rubber plug, with another conical face constituted by the tapered face.

In this case, owing to the provision of the outer housing and the spacer with the conical faces, it is possible to ensure the point-contact of the plugs with the outer housing and the spacer at the temporary engagement.

The latter object of the present invention described above can be accomplished by a method of producing a waterproof connector composed of a connector housing which has a plurality of terminal accommodating chambers adapted so as to accommodate a plurality of terminals therein, the method comprising the steps of:

preparing a plurality of wires; an inner housing provided, therein, with the plurality of terminal accommodating chambers in which a plurality of terminal are respectively accommodated corresponding to the wires; an outer housing into which the inner housing is to be fitted; a spacer to be disposed between the inner housing and the outer housing to retain the terminals accommodated in the terminal accommodating chambers; and rubber plugs each having cylindrical parts formed on both axial sides thereof and wire through-holes formed for allowing the wires through; wherein the outer housing has wire through-holes formed on its housing wall facing the terminal accommodating chambers of the inner housing being assembled into the outer housing, and rubber accommodating recesses formed on an inner side of the housing wall at respective positions opposing the wire through-holes, to receive the rubber plugs; the spacer has wire through-holes formed on its spacer wall facing the wire through-holes of the outer housing being engaged with the spacer, and recesses formed on an outer side of the spacer wall at respective positions opposing the wire through-holes of the spacer, to receive the cylindrical parts at respective ends of the rubber plugs; each of the rubber accommodating recesses of the outer housing is provided, on its inlet part for the rubber plug, with a tapered face inclined to the axial direction of the rubber accommodating recess; and each of the recesses of the spacer is provided, on its inlet part for the rubber plug, with a tapered face inclined to the axial direction of the recess;

accommodating the cylindrical parts of the rubber plugs in at least either ones of the rubber accommodating recesses of the outer housing and the recesses of the spacer, thereby effecting the temporary engagement between the rubber plugs and the outer housing or the spacer;

pinching the rubber plugs between the outer housing and the spacer;

inserting the wires into the respective through-holes of the outer housing, the rubber plugs and the inner housing; and connecting the wires with the terminals accommodated in the inner housing.

According to the invention, by accommodating the cylindrical parts of the rubber plugs into at least either ones of the rubber accommodating recesses of the outer housing and the recesses of the spacer at the temporary engagement, the rubber plugs can be prevented from being fallen from a space between the outer housing and the spacer. Therefore, the posture of the rubber plugs at the insertion of the wires can be stabilized to improve the assembling workability of the waterproof connector.

These and other objects and features of the present invention will become more fully apparent from the following description and appended claims taken in conjunction with the accompany drawings.

DESCRIPTION OF THE PREFERRED EMBODIMENT

An embodiment of the present invention will be described with reference to the drawings.

Figure 4:
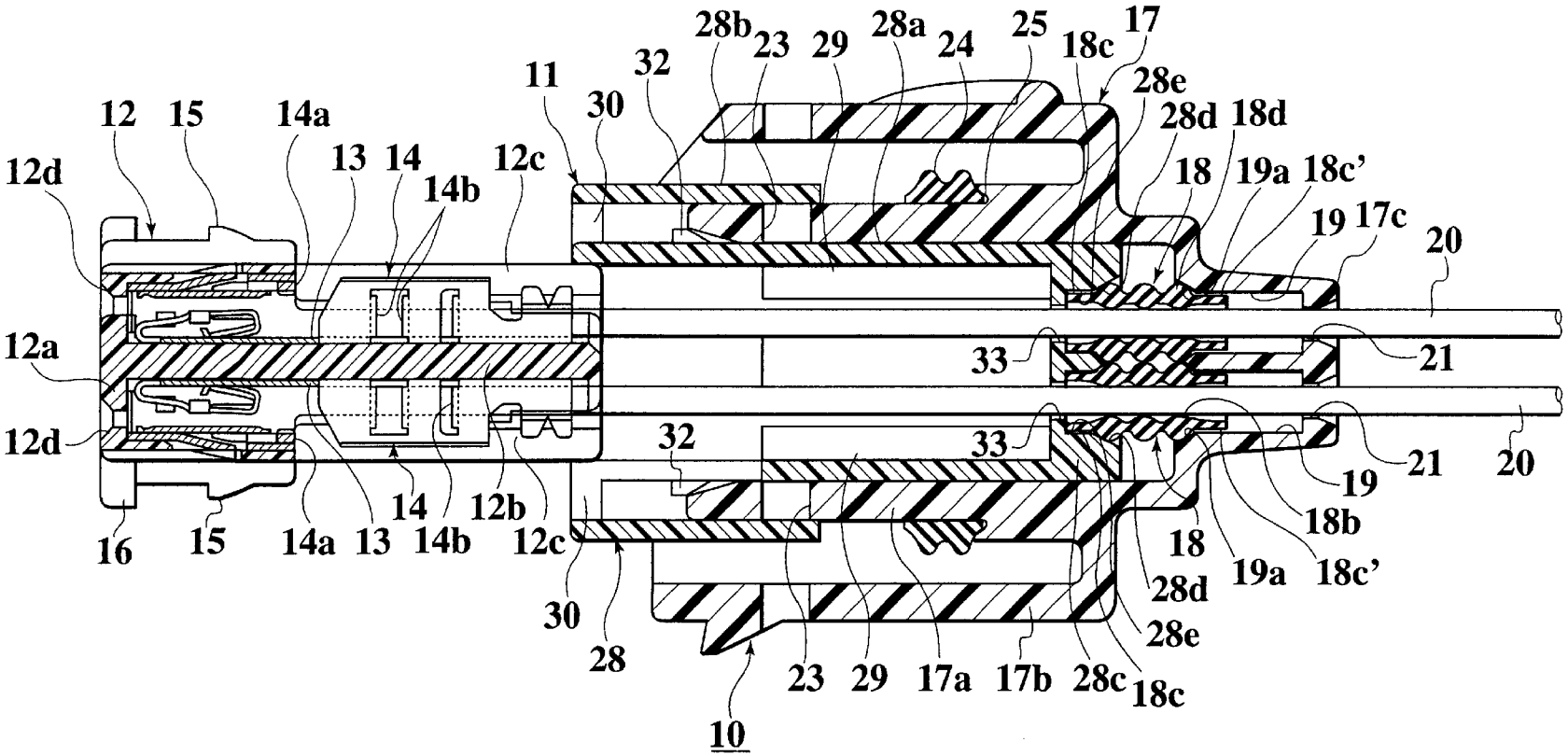
FIG. 4 is a sectional view of the waterproof connector in accordance with an embodiment of the present invention, showing the temporary engagement condition between the outer housing and the spacer.
Figure 5:
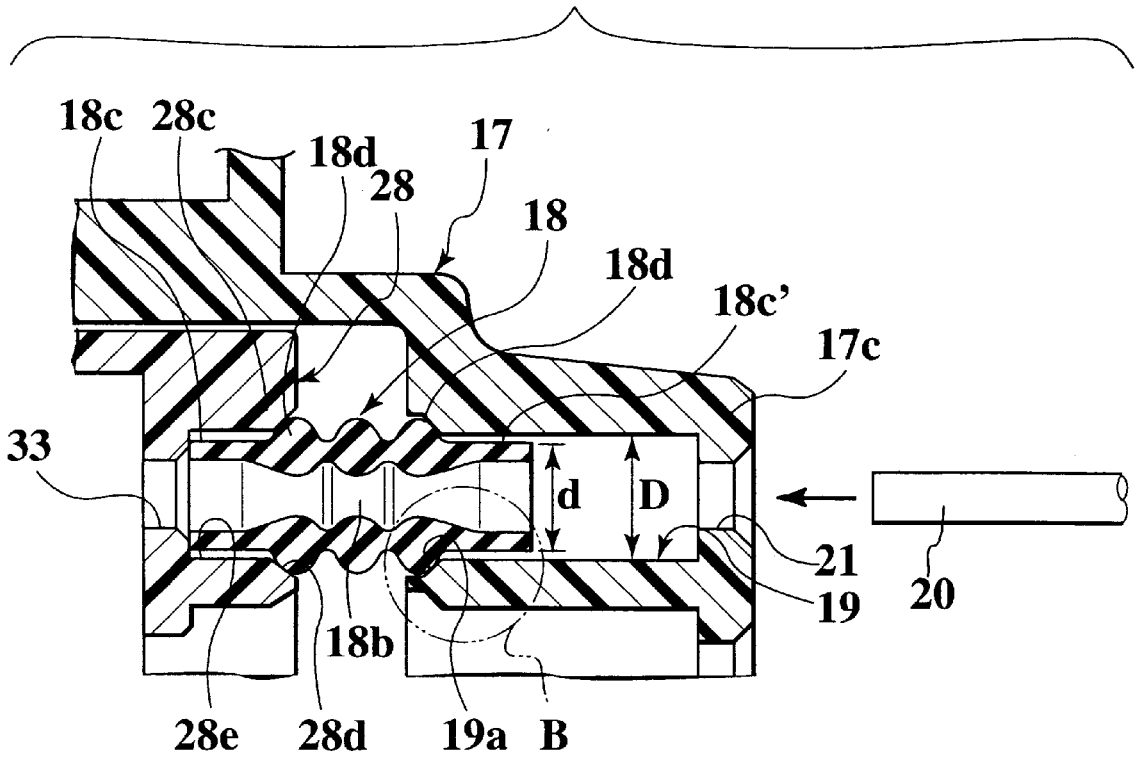
FIG. 5 is an enlarged explanatory diagram of the essential part of the waterproof connector of FIG. 4.
Figure 6:
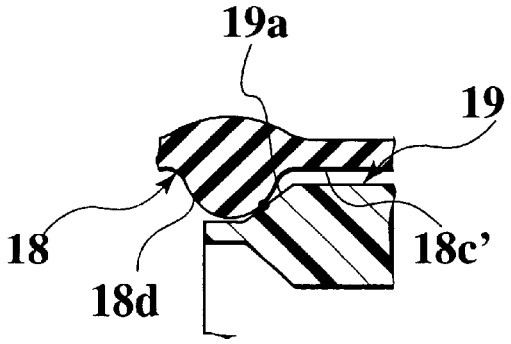
FIG. 6 is an enlarged sectional view of a part B in FIG. 5.

FIG. 4 is a sectional view of a waterproof connector 10 in accordance with one embodiment of the present invention, showing the temporary engagement condition between an outer housing and a spacer; FIG. 5 is an enlarged explanatory diagram of the essential part of the waterproof connector 10 of FIG. 4; and FIG. 6 is an enlarged sectional view of a part B in FIG. 5.

As shown in FIG. 4, a connector housing 11 of the waterproof connector 10 has a synthetic resinous inner housing 12 having a plurality of terminal accommodating chambers 13 formed integrally, a synthetic resinous outer housing 17 for fitting the inner housing 12 therein, and a synthetic resinous spacer 28 interposed between the inner housing 12 and the outer housing 17 to retain female terminals 14 accommodated in the terminal accommodating chambers 13 of the inner housing 12, as similar to the earlier art connector.

Figure 1:
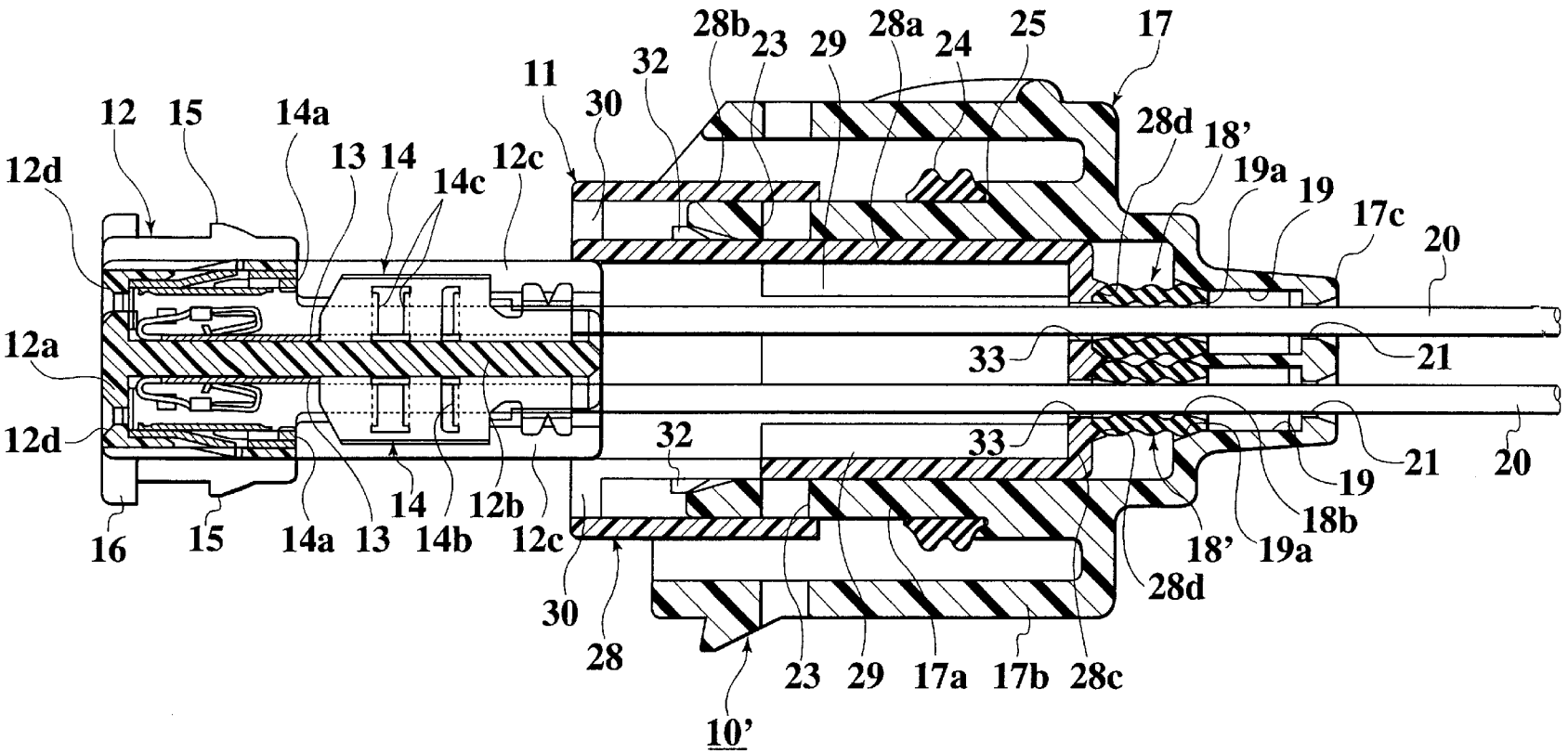
FIG. 1 is a sectional view of the earlier waterproof connector, showing the temporary engagement condition between an outer housing and a spacer.

Inside a bottom wall part (one wall part) 17*c* of the outer housing 17, respective rubber-plug accommodation recesses 19 are provided, on respective inlet sides thereof, with reversed conical faces 19*a*, namely, tapered faces inclined to the recesses 19. While, the spacer 28 has recesses 28*e* formed on the outside of a thick bottom wall part (one wall part) 28*c* at a position opposing respective wire through-holes 33. Each recess 28*e* has the same diameter as each recess 19. Each recess 28*e* is also provided, on an inlet side thereof, with a reversed conical face 28*d* (i.e. tapered face inclined to the recesses 28*e*) also serving as a rubber-plug pusher. As to the assembling, before completely accommodating rubber plugs 18 into the rubber-plug accommodation recesses 19 on the outer housing 17, in other words, at the time of temporary engagement (FIG. 1) where the front side of a body 28*a* of the spacer 28 is fitted into an inner wall part 17*a* of the outer housing 17, the rubber plugs 18 are pinched between the reversed conical faces 19*a* of the recesses 19 and the reversed conical faces 28*d* for the wire through-holes 33 of the spacer 28.

As shown in FIGS. 4 and 5, each rubber plug 18 for allowing a wire 20 through has cylindrical straight parts 18*c*, 18*c*' formed on both axial sides of the plug body. Each outer diameter (d) of the respective cylindrical parts 18*c*, 18*c*' of the rubber plug 18 is established to be equal to or less than the diameter D of the recess 19 ($d \leqq D$). Between the straight parts 18*c* and 18*c*', each rubber plug 18 has a cylindrical part defined by uneven inner and outer peripheral faces. In detail, each rubber plug 18 has an annular projection 18*d* integrally formed about the periphery of a portion close to the cylindrical part 18*c*'. The projection 18*d* is contoured with a curved face (arc cross section) so as to effect the "point" contact with the reversed conical face 19*a* of the rubber accommodating recess 19 of the outer housing 17. Similarly, the rubber plug 18 has another annular projection 18*d* integrally formed about the periphery of a portion close to the cylindrical part 18*c*. This projection 18*d* is also contoured with a curved face (arc cross section) so as to effect the "point" contact with the reversed conical face 28*d* of the recess 28 of the spacer 28.

The other structures of the constituents of the connector housing 11 are similar to those of the previously mentioned waterproof connector 10'.

That is, the inner housing 12 is also provided with a box part 12*a* having upper and lower openings formed on rear sides of the housing 12. In the housing 12, the terminal accommodating chambers 13 are defined by a center horizontal wall 12*b* and upper and lower vertical sidewalls 12*c* in order to accommodate female terminals 14 in the chambers 13, respectively. On the upper and lower faces of the box part 12*a* and at the center of the part 12*a*, respective engagement claws 15 are formed integrally with the housing 12. Also, the housing 12 has flanges 16 integrally formed at respective front ends of the upper and lower faces of the box part 12*a*. Note, on the front wall of the box part 12*a* at respective positions corresponding to the terminal accommodating chambers 13, rectangular through-holes 12*d* are formed for allowing male terminals (not shown) of the mating connector through. The female terminals 14 each has a box part 14*a* provided, on each side plate thereof, with a pair of press-fitting edges 14*b*, 14*b* which are both folded at the rear part of the terminal 14.

The outer housing 17 comprises an inner wall 17*a* in the form of a substantially rectangular cylinder, an outer wall 17*b* in the form of a substantially rectangular cylinder as well, and a bottom wall 17*c* connected the inner and outer walls 17*a*, 17*b* with each other, providing a double-box having an opening at its front end. As shown in FIG. 4, the outer housing 17 has a thickened portion formed at the center of the bottom wall 17*c*, in comparison with other portions of the wall 17*c*. Formed in the bottom wall 17*c* are the rubber plug accommodating recesses 19 of large diameter and circular cross section, which exist at respective positions corresponding to the terminal accommodating chambers 13, for accommodating the waterproof rubber plugs 18. At the rear side of the thickened parts of the bottom wall 17*c*, wire through-holes 21 of small diameter and circular cross section are formed so as to communicate with the recesses 19, in order to allow the wires 20 through.

The inner wall 17*a* of the outer housing 17 has not-shown engagement holes formed on the upper and lower wall portions and arranged on both sides of the front part of each wall portion, for engagement with the engagement claws 15. Additionally, at respective frontal centers of the upper and lower wall portions forming the inner wall 17*a*, long-sized and rectangular engagement hole 23 are formed for engagement with the engagement holes 15. The outer housing 17 has a V-shaped packing receiver 25 integrally formed so as to project at the interior side of the inner wall 17*a*, for receiving a waterproof packing 24 in the form of a rubber ring.

The spacer 28 comprises a rectangular-cylindrical body part 28*a* in the form of a generally rectangular cylinder fitted to the inside face of the inner wall 17*a* of the outer housing 17, a flange part 28*b* in the form of a generally rectangular cylinder fitted to the outside face of the outer housing 17, and a bottom wall 26*c* of the body part 28*c*. With this constitution, the spacer 28 is provided in the form of a box having a front section opened.

Inside of the upper and lower walls forming the body part 28*a* of the spacer 28, ribs 29 are formed so as to project from the walls integrally, for engagement with the rear end of the box part 12*a* of the inner housing 12 and both rear ends of the box parts 14*a* of the female terminals 14 accommodated in the terminal accommodating chambers 13. Owing to the provision of the ribs 29, it is possible to prevent the terminals 14 from falling from the chambers 13.

Notches 30 are formed in a connecting part between the body part 28*a* and the flange part 28*b* of the spacer 28, at respective positions opposing the engagement claws 15 and the flange parts 16 of the inner housing 12. Outside the upper and lower walls forming the body part 28*a* of the spacer 28 between the notches 30, 30, engagement claws 32 are formed integrally with the body part 28*a*, for engagement with the engagement holes 23 of the outer housing 17. The flange part 28*b* of the spacer 28 is adapted so that its leading end retains the packing 24 engaged in the packing receiver 25 when the spacer 28 is fitted to the outer housing 17.

Corresponding to the wire through-holes 21 of the outer housing 17, the spacer 28 has also wire through-holes 33 formed in the bottom wall 28*c* so as to respectively oppose the holes 21 of the outer housing 17 in engagement with the spacer 28. The bottom wall 28*c* of the spacer 28 is configured so as to retain the rubber plugs 18 at the completion to fit the spacer 28 to the outer housing 17. Before being retained, the rubber plugs 18 have been inserted into the rubber plug accommodating recesses 19 in the bottom wall 17*c* of the outer housing 17. As shown in FIG. 4, the wires 20 penetrating through the through-holes 21 of the housing 17, respective through-holes 18*b* of the rubber plugs 18' and the through-holes 33 of the spacer 28, are disposed between the press-fitting edges 14*b*, 14*b* in respective pairs, into pressure-connection with the female terminals 14 accommodated in the terminal accommodating chambers 13 of the inner housing 12. With the above arrangement, the terminal accommodating chambers 13 and the wires 20 are waterproofed owing to the rubber plugs 18 and a rubber packing 24 interposed between the outer housing 17 and the spacer 28.

Now, we describe the assembling steps of the waterproof connector 10 of the embodiment. Prior to the assembling, the packing 24 is inserted into the packing receiver 25 on the inner wall 17*a* of the outer housing 17 forming the exterior of the connector housing 11.

Next, it is carried out to accommodate the cylindrical parts 18*c*, 18c' on both ends of each rubber plug 18 into the respective recesses 28*e* of the bottom wall 28*c* of the spacer 28 and the rubber plug accommodating recesses 19 inside the bottom wall 17*c* of the outer housing 17. Simultaneously, the front side of the body part 28*a* of the spacer 28 is fitted into the inner wall part 17*a* of the outer housing 17 for temporary engagement while the projecting parts 18*d*, 18*d* on both sides of each rubber plug 18 are interposed between the reversed conical faces 19*a* of each rubber plug accommodating recess 19 and the reversed conical faces 28*d* of the spacer 28 under "point" contact condition.

Figure 2:
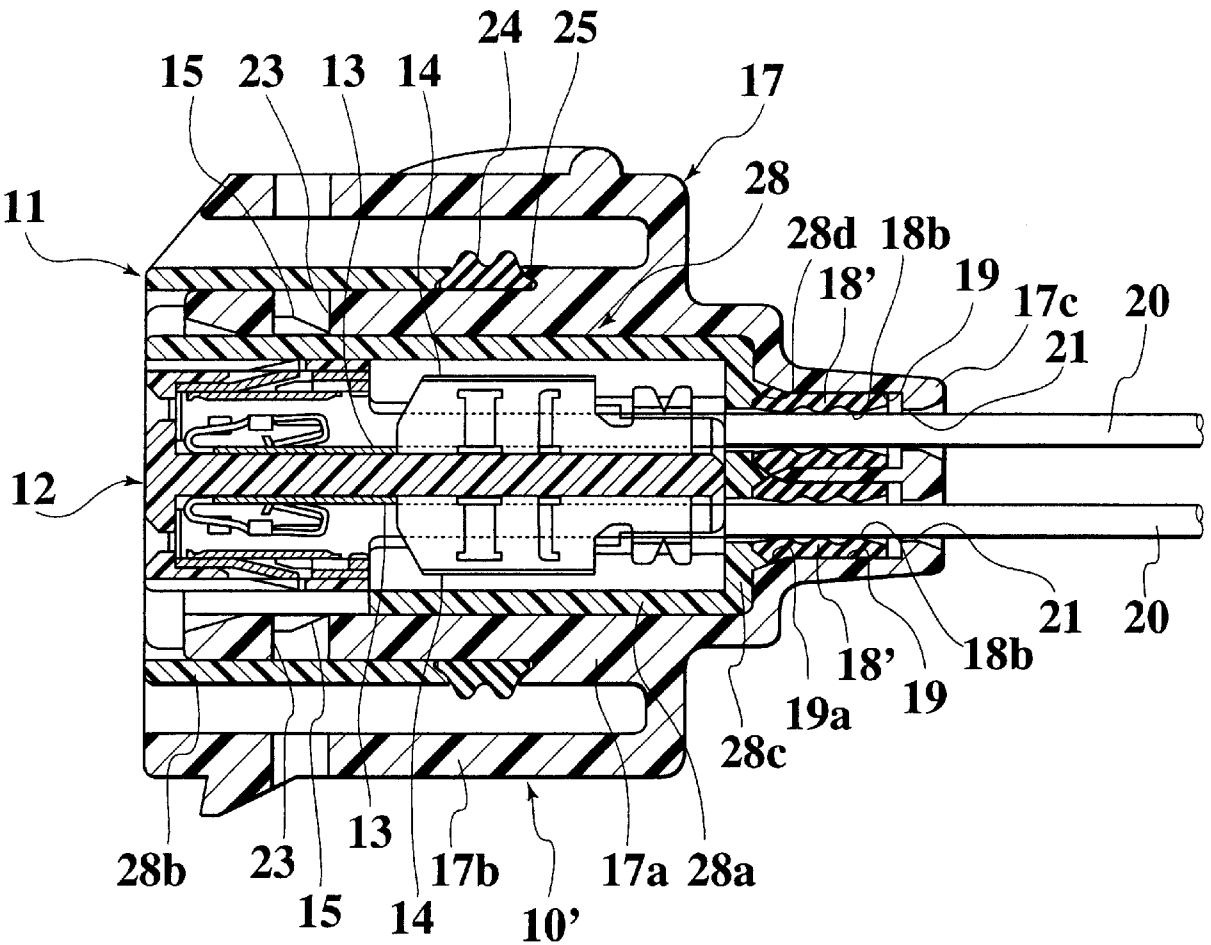
FIG. 2 is a sectional view of the earlier art waterproof connector, showing the formal engagement condition between the outer housing and the spacer.
Figure 3A:
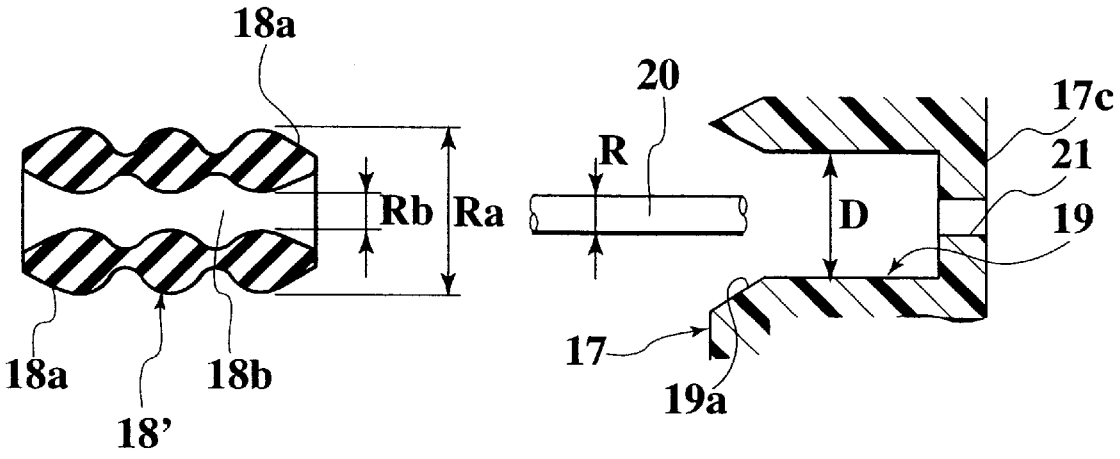
FIG. 3A is an enlarged explanatory diagram of an essential part of the waterproof connector of the earlier art and FIG. 3B is a partially enlarged explanatory diagram of the essential part.
Figure 3B:
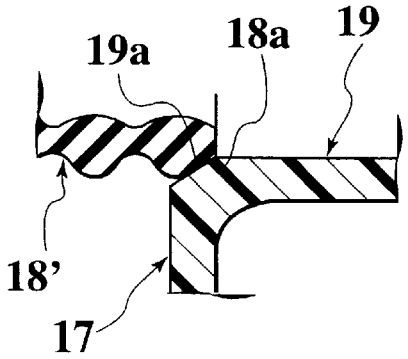

Then, as shown in FIG. 2, after inserting the wires 20 into the through holes 21 of the bottom wall 17*c* of the outer housing 17, the through-holes 18*b* of the rubber plugs 18 and the through-holes 33 of the spacer 28 in order, the wires 20 are press-fitted to the press-fitting edges 14*b*, 14*b* of the respective terminals 14 accommodated in the plural terminal accommodating chambers 13 of the inner housing 12 forming the interior of the connector housing 11.

Next, the inner housing 12 is fitted into the body part 28*a* of the spacer 28, while the body part 28 of the spacer 28 is completely fitted into the inner wall part 17*a* of the outer housing 17 for the formal engagement. Consequently, the spacer 28 allows the respective rubber plugs 18 to be press-fitted into the rubber accommodating recesses 19 by means of the recess 28*e* of the spacer 28 and the reversed conical faces 28*d*, thereby completing the assembling of the waterproof connector 10 in which the wires 20 are sealed up by the rubber plugs 18.

In this way, since each rubber plug 18 has the cylindrical parts 18*c*, 18*c*' accommodated in the recess 28*e* of the spacer 28 and the rubber accommodating recesses 19 of the outer housing 17 at the temporary engagement prior to the inserting of the wires (FIG. 5) where the projecting parts 18*d*, 18*d* on both sides of each plug 18 are pinched between the reversed face 19*a* of each recess 19 and the reversed face 28*d* of each recess 28*e*, it is possible to prevent the rubber plugs 18 from falling down through the space between the bottom wall 17*c* of the outer housing 17 and the bottom wall 28*c* of the spacer 28. Thus, when inserting the wires 20 into the through-holes 21, 18*b*, 33, it is possible to stabilize the posture of the rubber plugs 18, improving the assembling workability of the waterproof connector 10.

At the temporary engagement to pinch the rubber plugs 18 between the reversed faces 19*a* of the recesses 19 of the outer housing 17 and the reversed faces 28*d* of the recesses 28*e* of the spacer 28, the projecting parts 18*d* of the rubber plugs 18 come into "point" contact with the reversed faces 19*a* of the rubber plug accommodating recesses 19 of the outer housing 17. Accordingly, it is possible to stabilize and lower the frictional force between the rubber plug accommodating recesses 19 of the outer housing 17 and the rubber plugs 18 at the complete fitting the body part 28*a* of the spacer 28 in the temporary engagement condition into the inner wall part 17*a* of the outer housing 17 for the formal engagement. Therefore, it is possible to reduce the force required to insert the plugs 18 into the recesses 19, thereby improving the assembling workability of the waterproof connector 10.

Although the above-mentioned embodiment relates to the case of connecting the wires to the press-contact terminals under pressure, of course, the present invention is also applicable to a case of press-fitting the wires to the press-fitting terminals.

It will be understood by those skilled in the art that the foregoing description relates to an embodiment of the disclosed waterproof connector. Various changes and modifications may be made to the present invention without departing from the spirit and scope of the invention.

What is claimed is:

1. A waterproof connector composed of a connector housing which has a plurality of terminal accommodating chambers adapted so as to accommodate a plurality of terminal to be connected to electrical wires, and rubber plugs for insulating the terminals accommodating chambers and the wires from the outside of the connector housing in a waterproof manner, the connector housing comprising:

an inner housing having the terminal accommodating chambers formed therein;

an outer housing into which the inner housing is to be fitted; and a spacer disposed between the inner housing and the outer housing to retain the terminals accommodated in the terminal accommodating chambers; and wherein the outer housing has wire through-holes formed on its housing wall facing the terminal accommodating chambers of the inner housing being assembled into the outer housing, and rubber accommodating recesses formed on an inner side of the housing wall at respective positions opposing the wire through-holes, to receive the rubber plugs each provided, on both axial sides thereof, with cylindrical parts;

the spacer has wire through-holes formed on its spacer wall facing the wire through-holes of the outer housing being engaged with the spacer, and recesses formed on an outer side of the spacer wall at respective positions opposing the wire through-holes of the spacer, to receive the cylindrical parts of the rubber plugs;

each of the rubber accommodating recesses of the outer housing is provided, on its inlet part for the rubber plug, with a tapered face with respect to the axial direction of the rubber accommodating recess; and each of the recesses of the spacer is provided, on its inlet part for the rubber plug, with a tapered face inclined to the axial direction of the recess.

2. A waterproof connector as claimed in claim 1, wherein each of the rubber accommodating recesses of the outer housing is provided, on its inlet part for the rubber plug, with a conical face constituted by the tapered face and each of the recesses of the spacer is provided, on its inlet part for the rubber plug, with another conical face constituted by the tapered face.

3. A waterproof connector as claimed in claim 1, wherein each of the rubber plugs is provided, about its periphery of a portion close to the cylindrical part on one axial side, with an annular projection which is contoured by a curved face, for point-contact with the tapered face of each of the rubber accommodating recesses of the outer housing.

4. A waterproof connector as claimed in claim 3, wherein each of the rubber plugs is provided, about its periphery of another portion close to the cylindrical part on the other axial side, with another annular projection which is also contoured by a curved face, for point-contact with the tapered face of each of the recesses of the spacer.

5. A waterproof connector as claimed in claim 4, wherein each of the rubber plugs is provided, between the annular projections on both axial sides, with at least one annular projection which is also contoured by a curved face.

6. A method of producing a waterproof connector composed of a connector housing which has a plurality of terminal accommodating chambers adapted so as to accommodate a plurality of terminals therein, the method comprising the steps of:

preparing a plurality of wires; an inner housing having the plurality of terminal accommodating chambers formed so as to in which a plurality of terminal are respectively accommodated corresponding to the wires; an outer housing into which the inner housing is to be fitted; a spacer to be disposed between the inner housing and the outer housing to retain the terminals accommodated in the terminal accommodating chambers; and rubber plugs each having cylindrical parts formed on both axial sides thereof and wire through-holes formed for allowing the wires through; wherein the outer housing has wire through-holes formed on its housing wall facing the terminal accommodating chambers of the inner housing being assembled into the outer housing, and rubber accommodating recesses formed on an inner side of the housing wall at respective positions opposing the wire through-holes, to receive the rubber plugs; the spacer has wire through-holes formed on its spacer wall facing the wire through-holes of the outer housing being engaged with the spacer, and recesses formed on an outer side of the spacer wall at respective positions opposing the wire through-holes of the spacer, to receive the cylindrical parts at respective ends of the rubber plugs; each of the rubber accommodating recesses of the outer housing is provided, on its inlet part for the rubber plug, with a tapered face inclined to the axial direction of the rubber accommodating recess; and each of the recesses of the spacer is provided, on its inlet part for the rubber plug, with a tapered face inclined to the axial direction of the recess;

accommodating the cylindrical parts of the rubber plugs in at least either ones of the rubber accommodating recesses of the outer housing and the recesses of the spacer, thereby effecting the temporary engagement between the rubber plugs and the outer housing or the spacer;

pinching the rubber plugs between the outer housing and the spacer;

inserting the wires into the respective through-holes of the outer housing, the rubber plugs and the inner housing; and connecting the wires with the terminals accommodated-in the inner housing.

* * * * *

UNITED STATES PATENT AND TRADEMARK OFFICE

CERTIFICATE OF CORRECTION

PATENT NO. : 6,231,388 B1
DATED : May 15, 2001
INVENTOR(S) : Takao Murakami et al.

It is certified that error appears in the above-identified patent and that said Letters Patent is hereby corrected as shown below:

Column 9, claim 1,
Line 20, "terminal" should read -- terminals --.

Signed and Sealed this

Second Day of April, 2002

*Attest:*

*Attesting Officer*

JAMES E. ROGAN
*Director of the United States Patent and Trademark Office*